United States Patent [19]

Grubb

[11] 4,024,794

[45] May 24, 1977

[54] PNEUMATICALLY OPERATED CABLE-SLITTING TOOL

[75] Inventor: Daniel Baker Grubb, Hummelstown, Pa.

[73] Assignee: AMP Incorporated, Harrisburg, Pa.

[22] Filed: Feb. 2, 1973

[21] Appl. No.: 329,248

[52] U.S. Cl. ..... 91/189 A; 91/411 A; 92/62; 137/636.1

[51] Int. Cl.² ..... F15B 11/18

[58] Field of Search ..... 91/411 A, 465, 189; 137/596.2, 636, 636.1; 92/62

[56] References Cited

UNITED STATES PATENTS

| | | | |
|---|---|---|---|
| 512,790 | 1/1894 | Bachman | 92/62 |
| 2,118,098 | 5/1938 | Merenda | 91/189 X |
| 2,477,237 | 7/1949 | Carr | 137/636.1 X |
| 2,989,948 | 6/1961 | Forrester | 91/465 X |
| 3,149,537 | 9/1964 | Fink | 92/62 X |
| 3,188,103 | 6/1965 | Lowis | 137/596.2 X |
| 3,242,945 | 3/1966 | Nash | 137/636 X |
| 3,312,146 | 4/1967 | Quéré et al. | 91/465 X |
| 3,554,088 | 1/1971 | Bruyn | 91/411 A |
| 3,640,167 | 2/1972 | Axtmann | 83/380 |

*Primary Examiner*—Carlton R. Croyle
*Assistant Examiner*—Edward K. Look
*Attorney, Agent, or Firm*—Gerald K. Kita

[57] ABSTRACT

A three-position pneumatic tool having a toggle trigger for actuating a control rod which in turn controls a pair of pneumatic check-valves. Three interconnected, tandemly arranged piston assemblies are operatively associated with an air pressure source at one end while also being operatively associated with a work assembly at the other end. The trigger is spring-biased to a location wherein the tool is in a neutral workpiece engaging position. Actuation of the trigger in one direction will open one of the pneumatic valves whereupon air pressure acts upon the upper surface of one of the pistons so as to lower or retract the tool to a workpiece insertion position. Release of the trigger permits the tool to attain the workpiece engaged or neutral position. Rotation of the trigger in the opposite direction permits the other pneumatic valve to open whereupon air pressure acts upon the lower surfaces of all the pistons so as to raise and actuate the tool to the operating position.

3 Claims, 6 Drawing Figures

PNEUMATICALLY OPERATED CABLE-SLITTING TOOL

BACKGROUND OF THE INVENTION

1. Field of the Invention

The present invention relates generally to pneumatic tools and more particularly to an easily operated three-position pneumatic tool which may be used in various manufacturing operations.

2. Description of the Prior Art

The use of diverse pneumatic tools is generally well-known, but there appears to be a substantial need for a tool which is relatively small in size but yet is able to produce a substantially large actuating force. Various manufacturing assembly operations require the expenditure of a substantial force but in conjunction therewith must also be effected within a confined area, usually dictated by the size of the product being manufactured. Consequently, the means for carrying out the manufacturing process is usually those means other than pneumatic.

In the copending and commonly assigned application entitled, "Method and Tool For Preparing Three Conductor-Cable For Outlet Receptacle", Ser. No. 232,595, filed Mar. 7, 1972, now abandoned, there is disclosed a novel hand-operated tool for splitting the outer insulating covering of a three-conductor cable and separating the conductors thereof relative to the central ground wire, without severing the conductors and without disturbing the insulation of the individual conductive wires, for assembly with a specially designed outlet receptacle the disclosure of said copending and commonly assigned application is hereby specifically incorporated by reference. While this tool has been generally successfully employed, the capabilities of such tool can be greatly expanded through the use of a unique pneumatic actuator.

In addition, there also appears to be a substantial need for a three-position pneumatic tool, such as for example, a tool having a retracted or work-insertion position, a neutral or work-engaging position, and an operating position. In this manner, accurate and efficient manufacture is always possible. If, for example, a workpiece is to be aligned with the pneumatic tool, the tool may be positioned to its retracted location so as to insert the workpiece, and then moved to the engaging position which is immediately adjacent or contiguous to the workpiece. Consequently, errors cannot occur in the aligning process, as the tool may be subsequently retracted and re-engaged until proper alignment is attained.

Although the present application is described with respect to the preparation of three-conductor cable for use with a specially designed outlet receptacle, such is to be considered by way of example only, and is in no way to be considered a limitation upon the scope of the novel tool of the subject invention. The novel tool of the present invention is usable in diverse manufacturing processes wherein a substantially large reciprocal or impact-type force is necessitated but wherein a large machine tool cannot be spatially accommodated.

SUMMARY OF THE INVENTION

Accordingly, it is an object of the present invention to provide a pneumatic tool which is relatively small in size and yet capable of producing a relatively large reciprocal or impact-type force.

Another object of the present invention is to provide a pneumatic tool which is capable of being used within diverse manufacturing processes.

Still another object of the present invention is to provide a pneumatic tool which is easy to operate.

Yet another object of the present invention is to provide a pneumatic tool which facilitates rapid completion of manufacturing processes.

A further object of the present invention is to provide a pneumatic tool which facilitates the rapid completion of manufacturing processes whereby production is increased while production costs are reduced.

A still further object of the present invention is to provide a pneumatic tool which is adjustable relative to the workpiece.

Yet a further object of the present invention is to provide a pneumatic tool which is adjustable relative to a workpiece whereby accurate and efficient manufacture of the workpiece is facilitated.

The foregoing objectives are achieved according to this invention through the provision of a three-position pneumatic tool having a toggle-type trigger or level for controlling a pair of pneumatic check-valves, the lever being spring-biased to a location which corresponds to the tool's neutral position. Three interconnected piston and cylinder assemblies are tandemly arranged, one end of the assemblies being operatively associated with a pneumatic pressure source while the other end of the assemblies is operatively associated with a particular work assembly to be actuated by the pneumatic tool for effecting the particular manufacturing process. When the lever is in its non-actuated state, the tool is in its neutral or work-engaging position wherein both valves are closed thus preventing communication between the pneumatic pressure source and the piston and cylinder assemblies. To retract the tool from its neutral position, the toggle lever is rotated in a counter-clockwise direction whereby a control rod will open one of the pneumatic valves thereby permitting pneumatic pressure to act upon the upper surface of one of the pistons so that the pistons and the work assembly will be moved in a vertically downward direction to the tool's retracted position. On the other hand, rotation of the toggle lever in a clockwise direction will actuate the control rod so as to open the other pneumatic valve thereby permitting pneumatic pressure to act upon the lower surfaces of the pistons whereupon the pistons and the work assembly will be moved in a vertically upward direction to the tool's operating position thus permitting the work assembly to perform the particular manufacturing process. Thus, accurate and efficient manufacture of the workpiece may be accomplished since the tool may be retacted so as to insert the workpiece therein, subsequent to which the tool may be returned to its neutral position whereby the workpiece is engaged by the tool. In this manner, the workpiece may be properly aligned relative to the tool, by repeating the retraction and engagement steps several times if necessary, prior to actuating the tool to its actuated or work-performing position.

BRIEF DESCRIPTION OF THE DRAWINGS

Various other objects, features, and attendant advantages of the present invention will be more fully appreciated as the same becomes better understood from the following detailed description when considered in connection with the accompany drawings, in which like reference characters designate like or corresponding parts throughout the several views, and wherein.

DETAILED DESCRIPTION OF A PREFERRED EMBODIMENT

Figure 1:
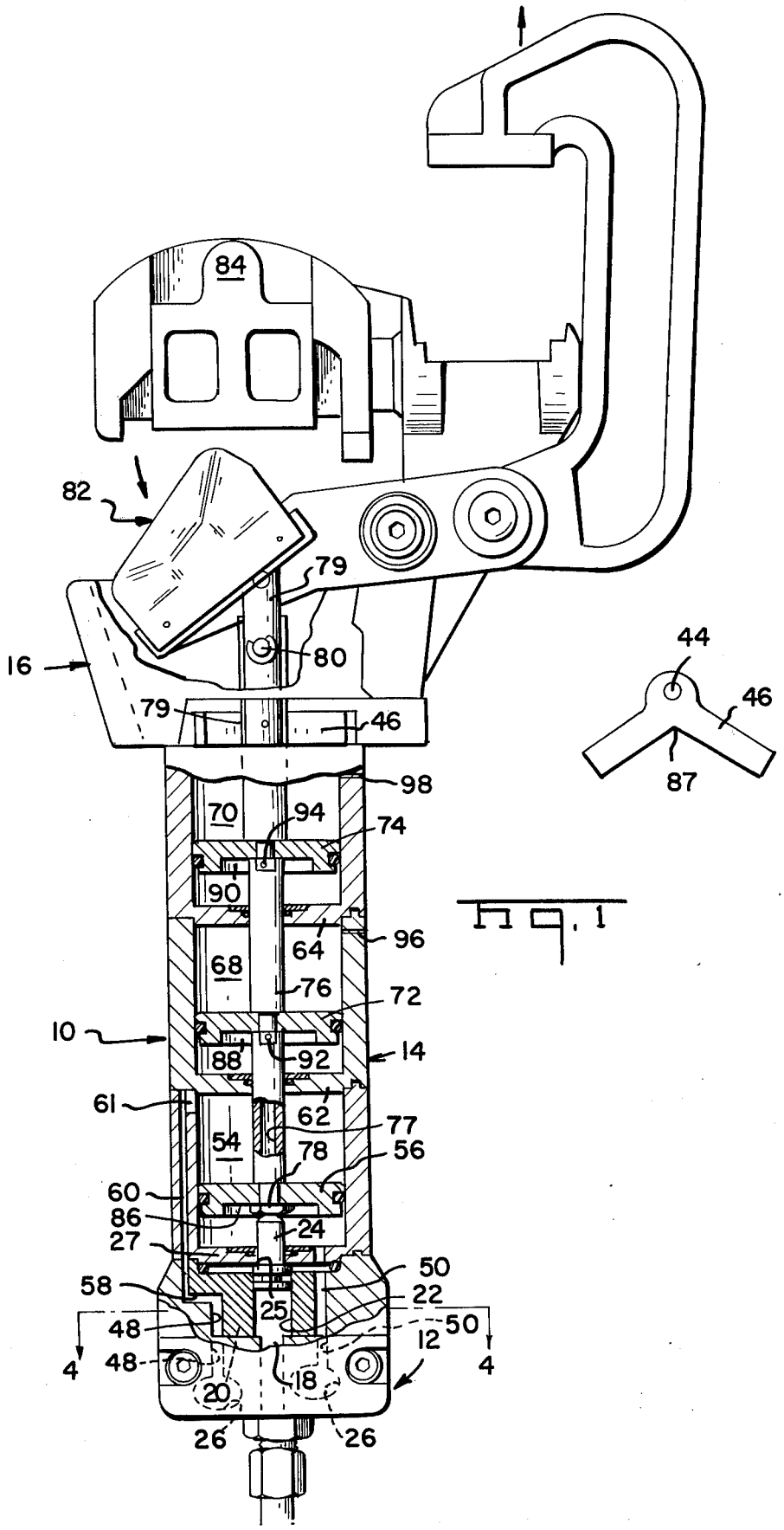
FIG. 1 is an elevation view, partly in section, of a three-position pneumatic tool constructed according to this invention, wherein the tool is in its neutral position.
Figure 4:
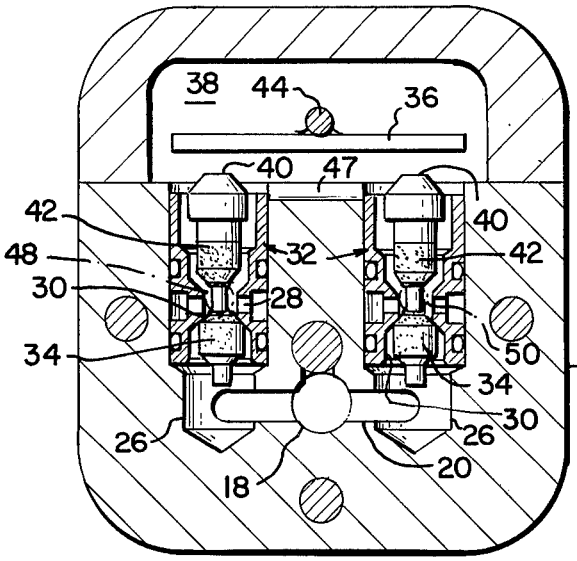
FIG. 4 is a horizontal sectional view, taken along the line 4—4 of FIG. 1, showing the position of the pneumatic valves when the tool is in its neutral state.

Referring now to the drawings, and more particularly to FIGS. 1 and 4 thereof, there is shown a pneumatic tool, generally indicated by the reference character 10, comprising a lower valving section 12, a middle cylinder-and-piston assembly 14, and an upper actuating section 16. Lower section 12 is substantially rectangular in horizontal cross-section and located along the lateral centerline of the section, but forward of the geometric center of the section, is a vertically extending air conduit 18 which serves to admit compressed air from a pressurized source, not shown, into the tool 10. Air conduit 18 is intersected by a horizontal, laterally extending passageway 20, and the upper section 22 of conduit 18, which is located above the horizontal plane of passageway 20, serves as a cylinder for a small piston 24, which as will become more apparent hereinafter, serves to place the tool in its neutral position. Piston 24 has a flanged portion 25 disposed about its lower end which acts as an abutment means, with the undersurface of a lower end wall 27 of assembly 14, for limiting the vertical rise of piston 24 relative to cylinder 22.

Figure 5:
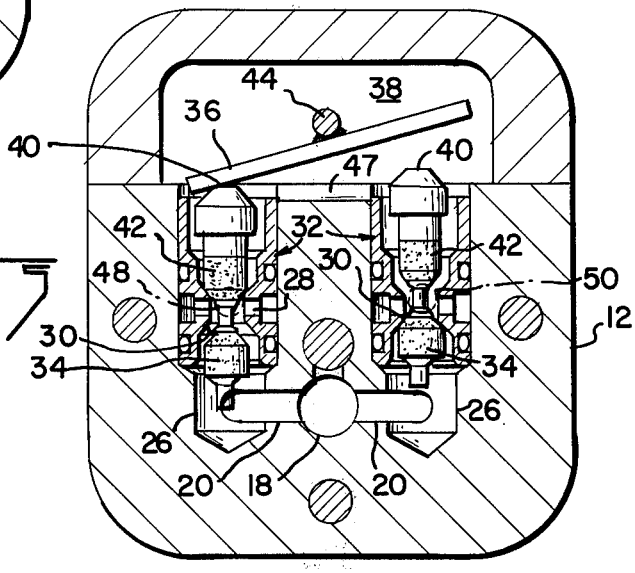
FIG. 5 is a horizontal sectional view, taken along the line 5—5 of FIG. 2, showing the position of the pneumatic valves when the tool is in its retracted state.
Figure 6:
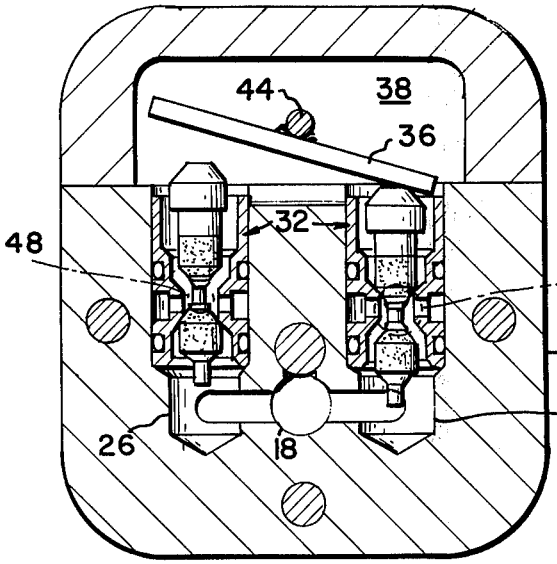
FIG. 6 is a horizontal sectional view, taken along the line 6—6 of FIG. 3, showing the position of the pneumatic valves when the tool is in its actuated state.

As shown in FIGS. 1 and 4 each end of passageway 20 falls vertically so as to lead into the forward portion of a pair of horizontal, longitudinally extending passageways 26, which are therefore located within a horizontal plane which is at a vertical level slightly below the horizontal plane within which passageway 20 is located. Each passageway 26 contains a venturi-type constriction 28, the ends 30 of constriction 28 serving as valve seats for a two-part, dual-position pneumatic check valve generally indicated by the reference character 32 which reciprocates within passageway 26 under the influence of the pneumatic pressure which acts upon the forward part 34 of valve 32, as well as under the influence of a single, horizontally pivotable control rod 36 which is located within a rear chamber 38 and which is long enough so as to be able to act upon the rear surface 40 of the rear part 42 of each valve 32, as shown in FIGS. 5 and 6. Control rod 36 is secured to a vertically extending shaft 44, which in turn, has secured thereto, at its upper end, a toggle control trigger 46 which is located within upper actuating section 16. Depending upon the actuated position of trigger 46, control rod 36 will actuate valves 32 whereupon the tool may be moved to any one of its three operative positions. Toggle trigger 46 is spring-biased to a position whereby control rod 36 will not contact either one of the valves 32, as shown in FIG. 4, the tool thus being in its neutral position. The rear portions of passageways 26 are connected to rear chamber 38 which includes a rear exhaust slot 47.

Disposed directly above, and in fluid communication with that portion of each passageway 26 defined between constrictions 28, are left and right vertically extending air conduits 48 and 50, respectively. Conduit 50 extends through the lower end wall 27 of middle, cylindrical casing 14 so as to open into a first, lowermost piston chamber 54, in which there is reciprocally disposed a first piston 56, whereupon air may act upon the lower surface of piston 56 to actuate it in an upward direction. On the other hand, conduit 48 branches off into a laterally, outwardly extending conduit portion 58 which is in turn connected to another vertically extending conduit 60 which extends upwardly from valving section 12 and through the vertically extending wall of cylindrical casing 14, casing 14 having a radial port 61 for facilitating fluid communication with the upper portion of conduit 60 and that portion of chamber 54 which is above piston 56 whereby piston 56 may be acutated in a downward direction. Casing 14 further includes two horizontal partition walls 62 and 64, disposed between an upper end wall 66 and lower end wall 27 so as to define therebetween three, equal, tandemly arranged piston chambers 54, 68, and 70, in which are disposed pistons 56, 72, and 74 respectively.

Figure 2:
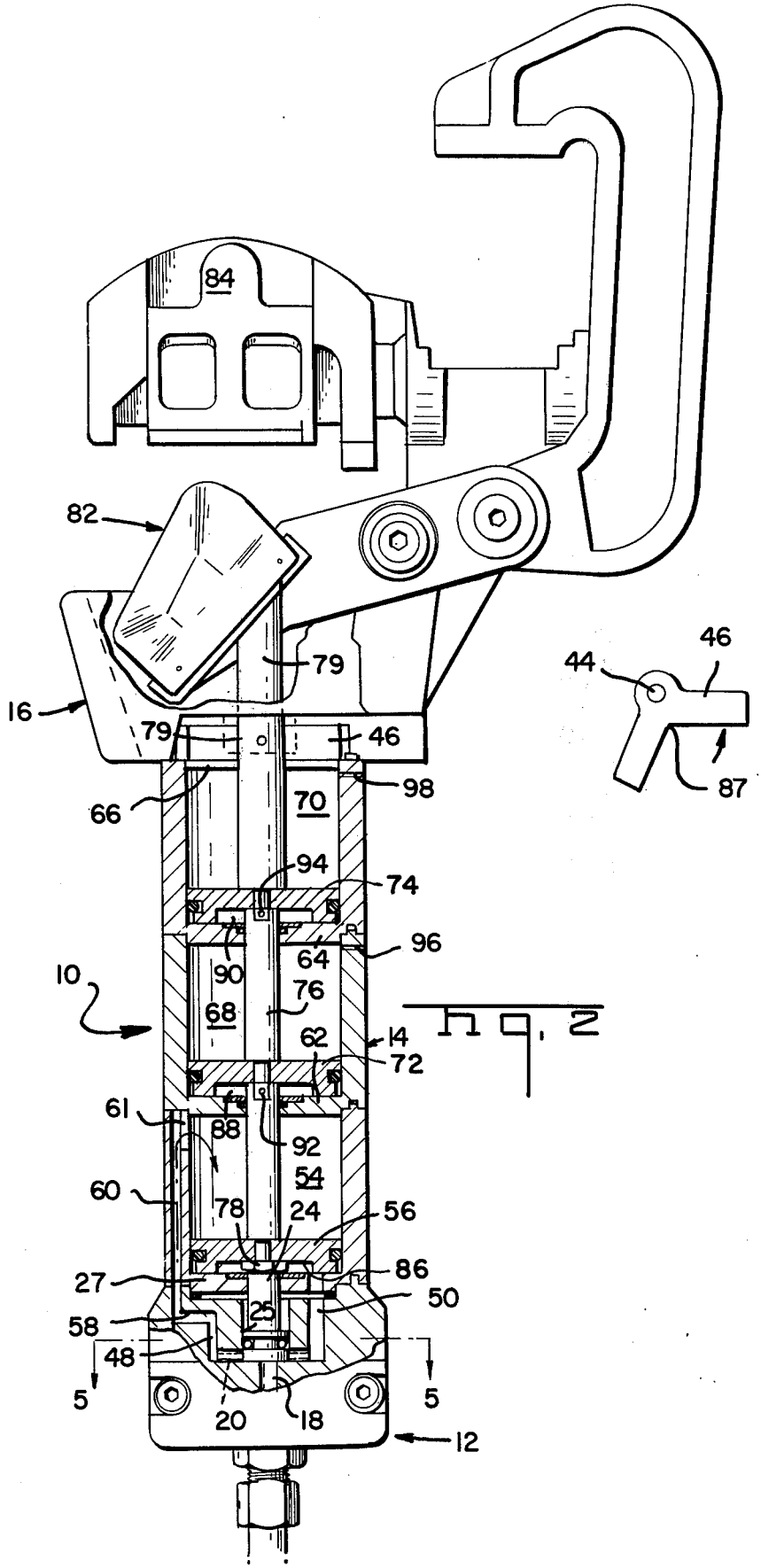
FIG. 2 is a view similar to that of FIG. 1, wherein however, the tool is in its retracted position.

Pistons 56, 72, and 74 are fixedly interconnected by means of an axial, hollow bolt 76 thereby providing a vertical fluid passageway 77 for fluidically interconnecting the piston chambers 68 and 70 with piston chamber 54. A hollow nut 78 secures the lower end of bolt 76 to piston 56, while the upper end of bolt 76 is secured to an actuating rod 79 by means of another bolt 80, rod 79 serving to actuate, for example, a specially designed three-conductor cable cutting assembly 82 relative to a clamping assembly 84 for performing a manufacturing operation which is discussed in greater detail in the aforementioned copending and commonly assigned application. Nut 78 is secured to bolt 76 within a recessed or countersunk portion 86 of piston so that upon the piston assembly being lowered or retracted to its bottom-out position as shown in FIG. 2, the lower face of piston 56 is permitted to be flush with the upper face of lower wall 27, whereby complete exhaust of the piston chambers will be permitted as will be apparent hereinafter. Rod 79 is positioned in front of, and within a recessed portion 87 of, trigger 46 thus permitting trigger 46 to be rotated about the vertical axis of shaft 44 by means of pivotally actuating or moving the trigger arms in a horizontal plane transversely relative to rod 79.

Similarly, the pistons 72 and 74, secured to bolt 76 by appropriate means, not shown, also include recessed portions 88 and 90 respectively, so as to provide for air ports 92 and 94, which serve to connect axial passageway 77 with piston chambers 68 and 70, and which provide for the complete exhaust of chambers 68 and 70. For example, with reference to FIG. 2, wherein the tool is in its retracted position, and the pistons are bottomed out, if the ports were located within bolt 76 but at a respective position below the lower surface of each piston, then proper exhaust of the air below each piston, when the tool is operated to its retracted mode, would not be able to occur through the ports for they would be closed or covered by the partition walls 62 and 64. Casing 14 further includes two radial ports 96 and 98 for respectively venting exhaust air from the upper portions of piston chambers 68 and 70 to the ambient atmosphere.

Still referring to FIGS. 1 and 4, the tool is shown in its neutral position. The spring-biased trigger 46 is in its non-actuated state, whereupon control rod 36 does not actuate either of the valves 32. Consequently, air entering conduit 18 from a compressed air source, not shown, flows through conduit 20 as well as upper section 22 of conduit 18. The air flowing through conduit 20 is conducted to passageways 26 whereupon both valves 32 are seated upon their respective forward valve seats under the influence of the incoming air, the valves thus terminating further communication between passageways 26 and conduits 48 and 50. Consequently, air cannot enter the lower portion of piston chamber 54 for actuating the tool to its up or actuated position, and likewise, air cannot enter the passageways 58, 60 and 61, and the upper portion of piston chamber 54 for moving the tool to its lowered or retracted position. On the other hand, since air has entered upper section 22 of conduit 18, small piston 24 is raised until its flanged portion 25 abuts the undersurface of cylindrical end wall 27, piston 24 serving to raise the piston assembly by means of engaging against nut 78.

Referring now to FIGS. 2 and 5, when it is desired to move the tool to its retracted position, such as for example, when inserting a workpiece, such as for example a three-conductor cable not shown, between cutting assembly 82 and clamping assembly 84, trigger 46 is rotated in a counterclockwise direction, which through the mechanism of vertical shaft 44, will similarly rotate control rod 36. Rod 36 will abut the rear surface 40 of the left valve 32 as viewed in FIG. 5, thereupon unseating the forward valve part 34 from its seat, while simultaneously seating the rear valve part 42. The right valve 32 is in the same position as it was previously when the tool was in its neutral state.

As shown in FIGS. 2 and 5, as a result of valve 34 being unseated, fluid communication is now permitted between the left passageway 26 and conduit 48. Consequently, air pressure enters the conduit 48, the conduit 60 and the port 61, and then into the upper portion of piston chamber 54 and acts upon the upper surface of piston 56 thereby retracting the entire piston assembly, actuating rod 79, and cutting assembly 82. Although air nevertheless continues to act upon small piston 24, the force acting upon piston 56 is much greater, and therefore piston 24 is moved downwardly also as shown in FIG. 2. The small volume of air disposed between the lower surfaces of pistons 72 and 74, and the upper surfaces of partition walls 62 and 64, respectively, will be exhausted through air ports 92 and 94, and axial passageway 77 (FIG. 1), and along with the air below piston 56, will be conducted through vertical conduit 50. Since the rear valve part 42 is unseated from its valve seat, air being exhausted by means of conduit 50 will be permitted to flow past valve 42 and into the chamber 38 so as to be exhausted through conduit 47.

When it is desired to return the tool to its neutral position, such as, for example, to engage and to pinch the workpiece between cutting assembly 82 and clamping assembly 84 prior to performing an operation upon the workpiece, in which state the workpiece may be adjusted so as to be properly aligned relative to assemblies 82 and 84, trigger 46 is released whereupon, by means of its spring-biasing action, the control rod 36 and therefore the valve 32, will be in their neutral positions as shown in FIG. 4. Consequently, inlet air cannot enter conduits 48 and 50, and in fact, a quantity of air disposed above the piston 56, which is equal to volume traversed by piston 24 moving piston 56 in an upward direction, will be exhausted through means of radial port 61, and conduits 60 and 48, whereupon the exhausted air will proceed to pass by the left rear valve part 42 to be exhausted through exhaust conduit 47. Similarly, air disposed above pistons 72 and 74 and below partitions 64 and 66, respectively, will be exhausted via radial ports 96 and 98.

Figure 3:
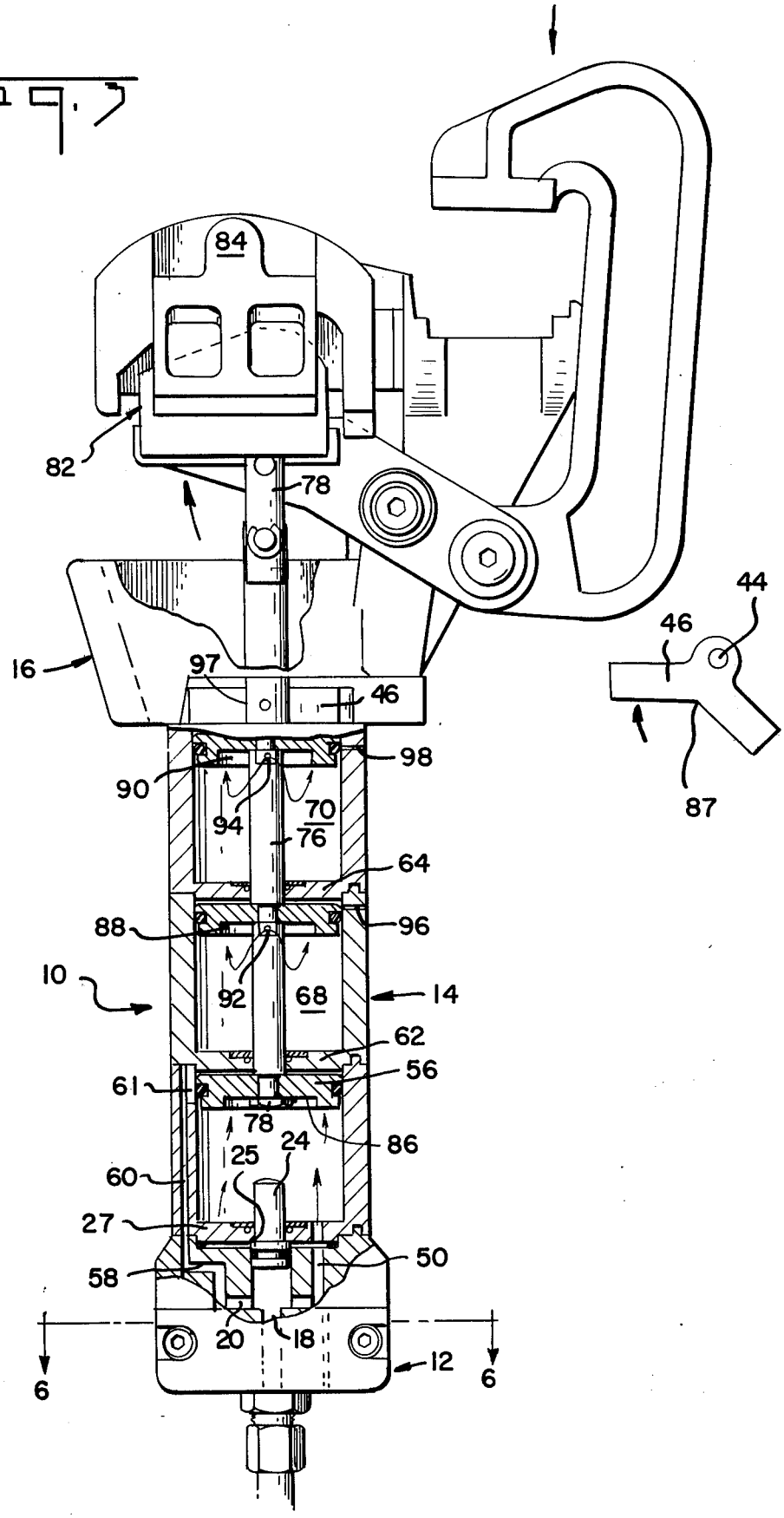
FIG. 3 is a view similar to that of FIG. 1, wherein however, the tool is in its actuated position.

After the workpiece is properly adjusted, the trigger 46 may be rotated in a clockwise direction, whereupon control rod 36, as well as the valves 32, will be in the relative positions as shown in FIG. 6. Communication is now permitted between passageway 26 and vertical conduit 50, forward valve part 34 having been unseated from its respective valve seat. Consequently, inlet air is permitted to enter piston chamber 54, whereupon, in addition to acting upon the lower face of piston 56, inlet air also enters axial passageway 77 without bolt 76, whereupon the air is subsequently conducted to piston chambers 68 and 70 by means of ports 92 and 94 as shown in FIG. 3. Thus, in effect, three sources of air, acting upon three tandemly arranged piston assemblies, actuate the pneumatic tool to its actuated position, whereby a substantially large force may be harnessed so as to perform the particular manufacturing operation. It is again noted that air disposed above piston 56 will be exhausted by means of port 61, conduits 60 and 48, and exhaust conduit 47, while air disposed above pistons 72 and 74 will be exhausted through ports 96 and 98 respectively.

To return the tool to its neutral position, trigger 46 is released thereby permitting rod 36 to return to its position shown in FIG. 4, and the right valve 32 to return to its neutral position under the influence of incoming air pressure. The supply of air to piston chamber 54 is thus terminated, whereupon the piston assembly begins to fall under the influence of gravity, air entrapped below the pistons 72 and 74 being exhausted through ports 92 and 94 and axial passageway 77 so as to enter chamber 54. The air within chamber 54 is then exhausted by means of conduit 50 which leads past the right rear valve part 42 for exhausting the air through conduit 47.

Thus, it may be seen that the pneumatic tool of the present invention has important advantages over the known prior art structures in that the tool is capable of quickly and simply providing a substantially large force, whereas the size of the tool is relatively small, the tool accomplishing this result through the use of a plurality of tandemly arranged piston assemblies which utilize a common supply of air pressure, the tool, in effect, being a force-multiplication mechanism. In addition, as the tool is a three-position tool, greater accuracy in manufacture is possible.

Obviously, many modifications and varations of the present invention are possible in light of the above teachings. It is to be understood therefore that within the scope of the appended claims the present invention may be practiced otherwise than as specifically described herein.

What is claimed as new and desired to be secured by Letters Patent of the United States is:

1. A pneumatic tool, comprising:

a work-performing assembly;

a piston assembly comprising three, tandemly arranged, interconnected pistons disposed within a cylindrical casing comprising three, tandemly arranged piston chambers;

first means for connecting said work-performing assembly to said piston assembly;

second means for supplying pressurized gas for actuating said piston assembly and said work-performing assembly to three, distinct, separate positions;

third means for selectively actuating said second means for supplying pressurized gas such that said pressurized gas acts upon and drives one of said pistons when actuating said assembly to a first position and acts upon and drives all of said pistons when actuating said assemblies to a third position, fourth means for urging said piston assembly to a second position intermediate said first and third positions, said second means for supplying pressurized gas including a first conduit means leading from a pressurized gas source, a second conduit means leading from said first conduit means to a lower portion of said first piston chamber, a third conduit means disposed within said first means for connecting said work-performing assembly to said piston assembly, said third conduit means leading from said first piston chamber to said second and third piston chambers, a fourth conduit means leading from said first conduit means to an upper portion of said first piston chamber, and pressurized gas actuated valve assemblies for opening and closing said second and fourth conduit means, wherein said pressurized gas normally actuates said valve assemblies to their respective closed positions thereby closing said second and fourth conduit means whereby the piston and work-performing assemblies are actuated to said second position by said fourth means.

2. A pneumatic tool as set forth in claim 1, wherein said third means for selectively actuating said second means for supplying pressurized gas includes control means for selectively opening and closing one of said valves while said pressurized gas simultaneously retains the other of said valves in its closed or open position, respectively, whereby said piston and work-performing assemblies may be selectively actuated to either one of said first and third positions.

3. A pneumatic device, comprising a work performing portion, a casing having a plurality of tandemly arranged piston chambers, a piston assembly having a plurality of tandemly arranged pistons fixedly mounted along a piston rod, each piston being received for reciprocation in a corresponding chamber, first conduit means for supplying air to said chambers to displace said pistons and said piston assembly toward said work performing portion, second conduit means for supplying air to at least one of said piston chambers to displace the corresponding piston and said piston assembly away from said work performing station, a secondary piston chamber containing a corresponding secondary piston in tandem with and engaging said piston assembly, third conduit means for supplying air to said secondary piston chamber to displace said secondary piston into engagement with said piston assembly and to displace both said secondary piston and said piston assembly toward said work performing station, stop means on said secondary piston chamber for limiting the displacement of said secondary piston toward said work performing station, a manually operated trigger having a first actuating position and a second actuating position and a manually released position, spring return means for biasing said trigger to said manually released position from either of said first or said second actuated position, and valve means, said trigger when manually actuated to said first actuated position supplying air by said valve means to said first conduit means, said trigger when manually actuated to said second actuated position supplying air by said valve means to said second conduit means, and said trigger when manually released biased by said spring return means to said manually released position supplying air by said valve means to said third conduit means, said secondary piston being of reduced diameter with respect to each of said pistons of said piston assembly and being disengaged from said piston assembly when said piston assembly is displaced toward said work performing station upon supply of air to said first conduit means.

* * * * *